US005750483A

United States Patent [19]

Welch et al.

[11] Patent Number: 5,750,483

[45] Date of Patent: May 12, 1998

[54] NON-PHOSPHATE MACHINE DISHWASHING COMPOSITIONS CONTAINING POLYCARBOXYLATE POLYMERS AND NONIONIC GRAFT COPOLYMERS OF VINYL ACETATE AND POLYALKYLENE OXIDE

[75] Inventors: Michael C. Welch, Woodhaven; Kenneth L. Zack, Wyandotte, both of Mich.

[73] Assignee: BASF Corporation, Mount Olive, N.J.

[21] Appl. No.: 568,032

[22] Filed: Dec. 6, 1995

[51] Int. Cl.[6] ..... C11D 3/37; C11D 3/39; C11D 3/395

[52] U.S. Cl. ..... 510/230; 510/226; 510/229; 510/374; 510/376; 510/378; 510/476

[58] Field of Search ..... 510/230, 223, 510/318, 360, 361, 398, 434, 476, 533, 226, 229, 374, 376, 378

[56] References Cited

U.S. PATENT DOCUMENTS

| | | | |
|---|---|---|---|
| 4,746,456 | 5/1988 | Kud et al. | 510/309 |
| 4,846,994 | 7/1989 | Kud et al. | 510/360 |
| 4,846,995 | 7/1989 | Kud et al. | 510/360 |
| 4,908,150 | 3/1990 | Hessel et al. | 510/393 |
| 4,999,869 | 3/1991 | Holland et al. | 8/115.62 |
| 5,049,302 | 9/1991 | Holland et al. | 510/299 |
| 5,049,303 | 9/1991 | Secemski et al. | 510/356 |
| 5,082,585 | 1/1992 | Hessel et al. | 510/393 |
| 5,227,446 | 7/1993 | Denzinger et al. | 527/314 |
| 5,318,719 | 6/1994 | Hughes et al. | 8/137 |
| 5,420,211 | 5/1995 | Hughes et al. | 525/404 |
| 5,534,183 | 7/1996 | Gopalkrishnan et al. | 510/434 |
| 5,536,440 | 7/1996 | Gopalkrishnan et al. | 510/417 |
| 5,565,145 | 10/1996 | Watson et al. | 510/350 |

FOREIGN PATENT DOCUMENTS

| | | |
|---|---|---|
| 0 358 473 A3 | 3/1990 | European Pat. Off. . |
| 0 358 474 B1 | 11/1994 | European Pat. Off. . |

OTHER PUBLICATIONS

Chemical Abstract accession No. 113:26003, for EP 358472, published Mar. 14, 1990.

Chemical Abstracts accession No. 124:204002, for CA 2146598, published Oct. 9, 1995.

Derwent Abstracts accession No. 96–058767/07 for CA 2146598, published Oct. 9, 1995.

*Primary Examiner*—Ardith Hertzog

*Attorney, Agent, or Firm*—Joanne P. Will

[57] ABSTRACT

An improved powdered non-phosphate, peroxygen based machine dishwashing compositions comprising a blend of nonionic surfactants, builders, non-chlorine bleach, bleach precursors, enzymes, polycarboxylate polymers and nonionic graft copolymers of vinyl acetate and polyalkyleneoxide wherein spotting and filming are substantially minimized.

18 Claims, No Drawings

NON-PHOSPHATE MACHINE DISHWASHING COMPOSITIONS CONTAINING POLYCARBOXYLATE POLYMERS AND NONIONIC GRAFT COPOLYMERS OF VINYL ACETATE AND POLYALKYLENE OXIDE

FIELD OF THE INVENTION

This invention relates to improved powdered, non-phosphate dishwashing compositions containing polycarboxylate polymers and nonionic graft copolymers of vinyl acetate and polyalkyleneoxide.

BACKGROUND OF THE INVENTION

Machine dishwashing formulations generally contain inorganic phosphate salts as builders to sequester calcium and magnesium ions in water to minimize filming of dishware. These formulations also contain available chlorine compounds which improve stain removal, sanitize dishes and help minimize the spotting and filming on dishware.

Because of environmental considerations associated with the use of phosphates as builders, formulations have been developed without phosphate and chlorine compounds. Non-phosphate formulations generally contain salts of low molecular weight organic acids, such as sodium citrate, as builders. Since citrate is not as effective a builder as phosphate, other additives, known to the art, such as polymers of acrylic acid, are used to minimize the increase in spotting and filming that occurs with non-phosphate formulations.

Detergent compositions containing nonionic graft copolymers of vinyl acetate and polyalkylene oxides are already known to the laundry art. Specifically, U.S. Pat. No. 4,746,456, issued May 24, 1988, assigned to BASF AG, discloses detergents containing added graft copolymers, which have an antiredeposition action on fabrics, produced by grafting polyalkylene oxides, having a number average molecular weight of from 2000 to 100,000, with vinyl acetate in a weight ratio of from 1:0.2 to 1:10, and up to 15% of whose acetate groups may be hydrolyzed.

EP 0 358 472A, published Mar. 14, 1990, assigned to Unilever, discloses a detergent composition having fabric soil anti-redeposition properties comprising:

(a) from 2 to 50% by weight of a detergent active system comprising one or more anionic, nonionic, cationic, zwitterionic or amphoteric surfactants;

(b) from 0.5 to 60% by weight of dipicolinic acid as a builder and (c) from 0.1 to 30% by weight of a graft copolymer of (i) polyethylene, polypropylene or polybutylene oxide with (ii) vinyl acetate (optionally partially saponified) in a weight ratio of (i) to (ii) of from 1:02 to 1:10.

EP 0 358 473B, issued Nov. 20, 1994, assigned to Unilever, discloses a detergent composition having fabric soil anti-redeposition properties comprising:

(a) from 2 to 50% by weight of a detergent active system comprising one or more anionic, nonionic, cationic, zwitterionic or amphoteric surfactants.

(b) from 15 to 50% by weight of crystalline or amorphous alkali metal aluminosilicate builder wherein the composition contains less than 10% by weight of inorganic phosphate builder;

(c) from 0.5 to 5% by weight of a polycarboxylate polymer comprising (meth)acrylate units and/or maleate units; and (d) from 0.1 to 3% by weight of a graft copolymer of (i) polyethylene, polypropylene or polybutylene oxide with (ii) vinyl acetate (optionally partially saponified) in a weight ratio of (i) to (ii) of from 1:02 to 1:10.

EP 0,358,474B, issued Nov. 17, 1994, assigned to Unilever, discloses a detergent composition having fabric soil anti-redeposition properties comprising:

(a) from 2 to 50% by weight of a detergent active system which includes a nonionic surfactant system consisting of one or more nonionic surfactants, the nonionic surfactant system having a cloud point (as hereinafter defined) not higher than 40° C.; and (b) from 0.1 to 3% by weight of a graft copolymer of (i) polyethylene, polypropylene or polybutylene oxide with (ii) vinyl acetate (optionally partially saponified), in a weight ratio of (i) to (ii) of from 1:0.2 to 1:10.

(c) 20–80% builder selected from alkali metal phosphates, polycarboxylates, polyacrylates, and citrates.

U.S. Pat. No. 5,082,585, issued Jan. 21, 1992 (assigned to Lever Bros.) discloses a detergent composition comprising lipase enzyme and nonionic polymers comprised of ethylene oxide copolymers and vinyl acetate. Other ingredients in the detergent composition include nonionic and anionic surfactants; builders (phosphate or non-phosphate) and bleaching agents.

U.S. Pat. No. 5,049,302, issued Sep. 17, 1991 (assigned to BASF) discloses a stable liquid detergent composition having improved anti-redeposition and soil release properties. The detergent composition is comprised of an anionic surfactant, a nonionic surfactant, a hydrotrope, a graft copolymer of polyalkylene oxide and an ester monomer, and a nonionic cellulosic anti-redeposition agent (Hydroxy propylmethyl cellulose). The graft copolymer is comprised of (a) a polyalkylene oxide and, (b) at least one vinyl ester in a weight ratio of (a):(b) of from 1:02 to 1:10.

U.S. Pat. No. 4,999,869, issued Mar. 19, 1991 (assigned to BASF) discloses dispersions of a polyethylene oxide (PEO)/vinyl acetate graft copolymer in water which impart soil release properties to motor oil stained polyester; wherein the ratio of PEO to vinyl acetate is 1:0.2 to 1:10. Further, up to 15% of the vinyl acetate groups are hydrolyzed.

Finally, U.S. Pat. No. 5,318,719 (U.S. '719) issued Jun. 7, 1994 (assigned to Rohm & Haas), discloses a purportedly biodegradable graft copolymer comprised of polyalkylene oxides and acid functional monomers such as vinyl acetate, wherein the ratio of polyalkylene oxide to acid functional monomers is 1:20 to 5:1 and the molecular weight is 1000–1000,000. Further, said graft copolymer is useful in detergent compositions for laundry and dish care applications. U.S. '719 also discloses representative detergent formulations comprising: 0.5–30% graft copolymer; 2–50% anionic or nonionic surfactants; less than 30% phosphate type builders or up to 85% sodium carbonate builder; up to 30% chlorine and non-chlorine bleaching agents; water; 1–200 ppm soluble metal salts such as copper sulfate, copper nitrate or copper chloride.

However, none of these references disclose the use of polycarboxylate polymers and nonionic graft copolymers of vinyl acetate and polyalkyleneoxide in totally, nonionic surfactant containing, non-phosphate automatic dishwashing compositions.

Further, the presently available non-phosphate formulations, while environmentally sound, are not as effective in preventing spotting and filming.

It has now been surprisingly discovered that the addition of polycarboxylate polymers and nonionic graft copolymers of vinyl acetate and polyalkyleneoxide dramatically minimizes the spotting and filming of non-phosphate non-ionic surfactant based machine dishwashing compositions.

SUMMARY

The present invention relates to an improved powdered, non-phosphate, peroxygen based machine dishwashing composition comprising a blend of nonionic surfactants, non-phosphate builders, non-chlorine bleach, bleach activators, enzymes, polycarboxylate polymers and nonionic graft copolymers of vinyl acetate and polyalkyleneoxides wherein said polycarboxylate polymer has a molecular weight of 500–250,000 and the structural formula:

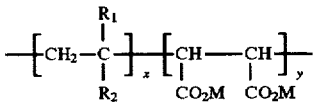

wherein $R_1$=H or $CH_3$; $R_2$ is $CO_2M$; M=H or an alkali metal; x=7–1500; y=0–1000. wherein further, said graft copolymers of vinyl acetate and polyalkyleneoxides is obtainable by grafting (a) a polyalkylene oxide having a number average molecular weight of from 300 to 100,000 and based on ethylene oxide, propylene oxide and/or butylene oxide with (b) vinyl acetate in a weight ratio (a):(b) of from 1:0.2 to 1:10.

DETAILED DESCRIPTION

The present invention relates to an improved powdered, non-phosphate, peroxygen based machine dishwashing composition comprising a blend of nonionic surfactants, non-phosphate builders, non-chlorine bleach, bleach activators, enzymes, polycarboxylate polymers and nonionic graft copolymers of vinyl acetate and polyalkylene oxides wherein said polycarboxylate polymer has a molecular weight of 500–250,000 and the structural formula:

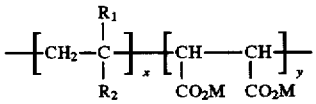

wherein $R_1$=H or $CH_3$; $R_2$ is $CO_2M$; M=H or an alkali metal; x=7–1500; y=0–1000 wherein further, said graft copolymers of vinyl acetate and polyalkyleneoxides is obtainable by grafting (a) a polyalkylene oxide having a number average molecular weight of from 300 to 100,000 and based on ethylene oxide, propylene oxide and/or butylene oxide with (b) vinyl acetate in a weight ratio (a):(b) of from 1:0.2 to 1:10.

NONIONIC SURFACTANTS

The dishwashing compositions of the present invention contain nonionic surfactants at levels of 0 to 15% by weight, preferably 0.1 to 10% by weight; most preferably 1 to 6% by weight. Nonionic surfactants can be broadly defined as surface active compounds which do not contain ionic functional groups. An important group of chemicals within this class are those produced by the condensation of alkylene oxide groups (hydrophilic in nature) with an organic hydrophobic compound; the latter is aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative but not limiting examples of the various chemical types of suitable nonionic surfactants include:

(a) polyoxyethylene or polyoxypropylene condensates of aliphatic carboxylic acids, whether linear or branched-chain and unsaturated or saturated, containing from about 8 to about 18 carbon atoms in the aliphatic chain and incorporating from 5 to about 50 ethylene oxide or propylene oxide units. Suitable carboxylic acids include "coconut" fatty acids (derived from coconut oil) which contain an average of about 12 carbon atoms, "tallow fatty acids (derived from tallow- class fats) which contain an average of about 18 carbon atoms, palmitic acid, myristic acid, stearic acid and lauric acid.

(b) polyoxyalkylene (polyoxyethylene or polyoxypropylene) condensates of aliphatic alcohols, whether linear- or branched- chain and unsaturated or saturated, containing from about 8 to about 24 carbon atoms and incorporating from about 5 to about 50 ethylene oxide or propylene oxide units. Suitable alcohols include the "coconut" fatty alcohol, "tallow" fatty alcohol, lauryl alcohol, myristyl alcohol and oleyl alcohol. INDUSTROL® DW5 surfactant is a preferred condensate of an aliphatic alcohol type surfactant. INDUSTROL® DW5 surfactant is available from BASF Corporation, Mt. Olive, N.J.

(c) polyoxyalkylene (polyoxyethylene or polyoxypropylene) condensates of alkyl phenols, whether linear- or branched-chain and unsaturated or saturated, containing from about 6 to about 12 carbon atoms and incorporating from about 5 to about 25 moles of ethylene oxide or propylene oxide.

(d) Particularly preferred nonionic surfactants are selected polyalkylene oxide block copolymers. This class can include polyethoxylated polypropoxylated propylene glycol sold under the tradename "PLURONIC®" made by BASF Corporation of Mt. Olive, N.J., or polypropoxylated-polyethoxylated ethylene glycol sold under the tradename "PLURONIC-R®" made by the BASF Corporation, Mt. Olive, N.J. The first group of compounds are formed by condensing ethylene oxide with a hydrophobic base formed by the condensation of propylene oxide with propylene glycol (see U.S. Pat. No. 2,674,619). The hydrophobic portion of the molecule which, of course, exhibits water insolubility, has a molecular weight from about 1500 to 1800. The addition of the polyoxyethylene radicals to this hydrophobic portion tends to increase the water solubility of the molecule as a whole and the liquid character of the product is retained up to the point where the polyoxyethylene content is about 50 percent of the total weight of the condensation product. The latter series of compounds called PLURONIC-R® are formed by condensing propylene oxide with the polyethoxylated ethylene glycol condensate. This series of compounds is characterized by having an average molecular weight of about between 2000 and 9000 consisting of, by weight, from about 10 to 80 percent polyoxyethylene, and a polyoxypropylene portion having a molecular weight between about 1000 and 3100.

U.S. Pat. Nos. 4,366,326; 4,624,803; 4,280,919; 4,340,766; 3,956,401; 5,200,236; 5,425,894; 5,294,365; incorporated by reference herein, describe in detail nonionic surfactants useful in the practice of this invention. *Surfactant Science Series*, edited by Martin J. Schick, Non Ionic Surfactants, Vols. 19 and 23 provide detailed description of nonionic surfactants and are incorporated by reference herein. Finally, surfactant blends prepared from the surfactants described herein can be used in the practice of the present invention.

ANTIFOAMERS

The compositions of the present invention may contain anti-foaming agents. Preferred anti-foaming agents are silicone anti-foaming agents used at a level of 0.2–1.0% by weight. These are alkylated polysiloxanes and include polydimethyl siloxanes, polydiethyl siloxanes, polydibutyl siloxanes, phenyl methyl siloxanes, diethylsilanated silica. Other suitable anti-foaming agents are sodium stearate used at a concentration level of about 0.5 to 1.0 by weight, monostearyl acid phosphate used at a concentration level of about 0 to about 1.5% by weight, more preferably about 0.1 to about 1.0% by weight.

NON-PHOSPHATE BUILDERS

The dishwashing compositions of the present invention also contain approximately 2–40% by weight, preferably 4–40% by weight, more preferably 5–30% by weight, of non-phosphate builders such as, but not limited to various water-soluble, alkali metal, ammonium or substituted ammonium carbonates, and silicates. Preferred are the alkali metal carbonates, especially the sodium salts.

Specific examples of nonphosphorous, inorganic builders are sodium and potassium carbonate, bicarbonate, sesquicarbonate, tetraborate decahydrate, and silicate.

Water-soluble, non-phosphate organic builders useful herein also include non-polymeric polycarboxylates. Examples of non-polymeric polycarboxylate builders are the sodium, potassium, lithium, ammonium and substituted ammonium salts of ethylenediametetraacetic acid, nitrilotriacetic acid, oxydisuccinic acid, mellitic acid, benzene polycarboxylic acids, citric acid, and methyl glycine diacetic acid ("MGDA").

Other useful builders are sodium and potassium carboxymethyloxymalonate, carboxymethyloxysuccinate, cis-cyclo- hexanehexacarboxylate, cis-cyclopentanetetracarboxylate, and phloroglucinol trisulfonate.

Additional suitable non-polymeric polycarboxylates are the polyacetyl carboxylates described in U.S. Pat. No. 4,144,226, issued Mar. 13, 1979 to Crutchfield, et al, and U.S. Pat. No. 4,246,495 issued Mar. 27, 1979 to Crutchfield, et al, both incorporated herein by reference.

Further, other detergency builder materials useful herein are the "seeded builder" compositions disclosed in Belgian Patent No. 798,856, issued Oct. 29, 1973, incorporated herein by reference. Specific examples of such seeded builder mixtures are: 3.1 wt. mixtures of sodium carbonate and calcium carbonate having 5 micron particle diameter, 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 calcium hydroxide having a particle diameter of 0.01 micron and a 3:3:1 wt. mixture of sodium carbonate, sodium aluminate and calcium oxide having particle diameter of 5 microns.

Complete descriptions of useful non-phosphate builders useful in the practice of this invention, are described in EP 0,358,474B, U.S. Pat. No. 5,049,303; EP 0 358,472 A, incorporated by reference herein.

NON-CHLORINE BLEACH COMPOUNDS AND BLEACH PRECURSORS

The compositions of the present invention contain certain non-chlorine bleach compounds such as, but not limited to, organic peroxy acids and diacyl peroxides. Said non-chlorine bleach compounds are present at a level of 0 to 20% by weight; preferably from 5 to 15 15% by weight; more preferably from 6 to 10% by weight. The peroxy acids usable in the present invention are solid compounds and substantially stable in the temperature range of about 40° C. to about 50° C.

Typical monoperoxy acids useful herein include alkylperoxy acids and arylperoxy acids such as:

(i) peroxybenzoic acid and ring-substituted peroxybenzoic acids, e.g. peroxy-alphanaphthoic acid, and magnesium monoterphtalate.

(ii) aliphatic and substituted aliphatic monoperoxy acids, e.g. peroxylauric acid, peroxystearic acid and 6-(N-phtyalimido)peroxyhexanoic acid. Typical diperoxy acids useful herein include alkyl diperoxy acids and arydiperoxy acids, such as:

(iii) 1,12-diperoxydodecanedoic acid (iv) 1,9-diperoxyazelaic acid (v) diperoxybrassylic acid; diperoxysebacic acid and diperoxysiophthalic acid (vi) 2-decyldiperoxybutane-1,4-dioic acid.

A typical diacylperoxide is dibenzoylperoxide.

Inorganic peroxygen compounds may also be suitable. Examples of these materials are salts of monopersulfate, perborate monohydrate, perborate tetrahydrate and percarbonate.

Examples of suitable chlorine-free oxygen donating bleaches also include perhydrates and peroxy compounds, as well as mixtures thereof. Perhydrates preferably include alkali metal compounds of perborates in the form of tetra- or monohydrates, perborax, percarbonates, persilicates, citrate perhydrates as well as perhydrates of urea and melamine compounds. Furthermore, acidic persalts, such as persulphates (e.g. caroates), perbenzoates, and peroxycarboxylic acids, such as peroxyphthalate, magnesium monoperoxyphthalic acid, diperoxyphthalic acid, 2-octyl-diperoxy-succinic acid, diperoxydodecane dicarboxylic acid, diperoxyazelaic acid, amidoperoxycarboxylic acid, as well as salts and mixtures thereof.

Particularly preferred non-chlorine bleaches are sodium percarbonate and sodium perborate.

PEROXYGEN BLEACH PRECURSORS

Peroxygen bleach precursors are compounds which react in the bleaching solution with hydrogen peroxide from an inorganic peroxygen source to generate an organic peroxy acid. They are also susceptible to hydrolysis and cannot normally be formulated directly into aqueous cleaning compositions. Precursors would be incorporated into products along with a source of hydrogen peroxide, which could optionally be encapsulated. Bleach precursors are present at a level of 0 to 7% by weight; preferably 1 to 5% by weight; more preferably 3 to 5% by weight.

Bleach precursors for peroxy bleach compounds have been amply described in the literature, including in British Nos. 836,988; 855,735; 907,358; 907,950; 1,003,310 and 1,246,339; U.S. Pat. Nos. 3,332,882 and 4,128,494; Canadian No. 844,481 and South African No. 68/6,344.

Typical examples of precursors are polyacrylated alkylene diamines, such as N,N,N,N,-tetracetylethylene diamine (TAED) and N,N,N',N'-tetracetylmethylene diamine (TAMD); acrylated glycolurils, such as tetracetylglycoluril (TAGU); triacetylcyanurate, sodium sulphophenyl ethyl carbonic acid ester, sodium acetyloxybenzene sulfonate (SABS), sodium nonanoyloxbenzene sulfonate (SNOBS) and choline sulfophenyl carbonate. TAED is a preferred bleach precursor.

Peroxybenzoic acid precursors are known in the art, e.g. from GB-A-836988. Examples thereof are phenylbenzoate;

phenyl p-nitrobenzoate; o-nitrophenyl benzoate; o-carboxyphenyl benzoate; p-bromobenyl benzoate; sodium or potassium benzoyloxybenzensulfonate; and benzoic anhydride.

Other suitable precursors are described in U.S. Pat. No. 4,711,748 and U.S. Ser. No. 07/497,709 filed on Mar. 16, 1990 by Batal et al describing N-sulfonyloxyziridine compounds and U.S. Ser. No. 07/494,713, filed on Mar. 16, 1990 by Batal et al describing sulfonamine compounds herein incorporated by reference. The activators may be admixed with, or absorbed upon other compatible ingredients.

Suitable bleach precursors are also described in U.S. Pat. Nos. 5,200,236; 5,151,212; 4,619,779; incorporated by reference herein.

ENZYMES

The compositions of the present invention may also contain enzymes, such as but not limited to, lipases, amylases and proteases. Proteases such as Purafect Oxam®, Maxamill®, Purafect®, Purafect OXP®, Maxacal®, Maxapem®, Maxatase® are available from Genencor; amylases such as Termamyl® and Lumafast®, are also available from Genencor; and proteases such as Alcalase®, Savinase® and Esperase® are available from Novo Industries A/S. Proteases are present at a level of 0.5 to 10% by weight; preferably 0.7 to 9% by weight; most preferably 0.8 to 8% by weight; amylases are present at a level of 0.3 to 10% by weight, preferably 0.4 to 9% by weight; most preferably 0.5 to 8% by weight; lipases are present at a level of 0 to 8% by weight.

Further, U.S. Pat. Nos. 5,173,207 and 5,240,633 describe enzymes useful in the practice of this invention and are incorporated by reference herein.

FILLERS

An inert particulate filler material which is water-soluble may also be present in cleaning compositions in powder form. This material should not precipitate calcium or magnesium ions at the filler use level. Suitable for this purpose are organic or inorganic compounds. Organic fillers include sucrose esters and urea. Representative inorganic fillers include sodium sulfate, sodium chloride and potassium chloride. A preferred filler is sodium sulfate. Its concentration any range from 0% to 60%, preferably from about 10% to about 30% by weight of the cleaning composition.

OPTIONAL INGREDIENTS

Additionally, one skilled in the art understands that small amounts of perfumes, colorants and antibacterial agents may be added to the dishwashing detergent compositions of the present invention.

POLYCARBOXYLATE POLYMERS AND NONIONIC GRAFT CO-POLYMERS OF VINYL ACETATE AND POLYALKYLENEOXIDE

Finally, the dishwashing compositions of the present invention contain polycarboxylate polymers and nonionic graft copolymers of vinyl acetate and polyalkyleneoxides wherein said polycarboxylate polymer POLYMER has a molecular weight of 500–250,000 and the structural formula:

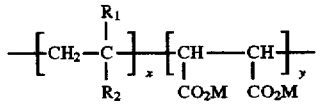

wherein $R_1$=H or $CH_3$; $R_2$ is $CO_2M$; M=H or an alkali metal; x=7–1500; y=0–1000; The polycarboxylates comprise homopolymers or copolymers of acrylic acid, methacrylic acid, maleic acid, fumaric acid, itaonic acid, and the like. They may be polyacrylic acid, polymethacrylic acid, or a copolymer of acrylic and methacrylic acids, said homopolymer or copolymer and range in molecular weight from about 500 up to about 250,000 depending on the degree of crosslinking.

While the preparation of polyacrylates from acrylic acid and methacrylic acid monomers is well known in the art and need not be detailed here, the following will illustrate the general technique that can be used. The polymerization of acrylic acid to polyacrylic acid can be stopped at any appropriate molecular weight (determined by viscosity). The conditions under which it is polymerized will result in different performance characteristics for similar molecular weight polymers. If, for example, the polymerization took place under a condition of a high temperature (100°–150° C.), there will be a strong tendency for crosslinking to occur. Crosslinking is undesirable as it decreases the apparent acid strength of the polyacid by preventing the expansion of the molecules, which would otherwise increase the separation between carboxylic groups. This results in two distinct adverse effects. First, the solubility of the polymer is reduced and, second, the chelation ability is reduced. It should be noted that the higher the molecular weight, the more likely extensive crosslinking, occurs. It is, however, possible to produce polyacrylic acid having molecular weights in the millions without extensive crosslinking by reacting the monomers under very mild conditions.

Water soluble salts of acrylic acid and methacrylic acid homopolymers as described above are especially preferred for the purposes of the invention. The water soluble salt can be an alkali metal, ammonium or substituted (quaternary) ammonium salt. The alkali metal can be sodium or potassium. The sodium salt is preferred. The salt can be used in a partially or fully neutralized form. Also, partial neutralization and esterification of the carboxylic acid groups can be carried out while still retaining the effective properties of the homopolymer. The homopolymers are converted to the desired salt by reaction with the appropriate base, generally with a stoichiometric excess of the desired percent of conversion. Normally 100 percent of the carboxyl groups present will be converted to the salt, but the percentage can be less in certain situations. In general, the homopolymer of the invention in the acid form before conversion to a salt or ester, will have a molecular weight of from about 500 to 250,000, preferably about 500 to 70,000, even more preferably, about 1,000 to 20,000 and, most preferably, about 1,000 to 10,000.

A preferred water soluble polycarboxylate polymer is a sodium salt of polyacrylic acid, having a molecular weight of 500–250,000; more preferably 500–70,000; most preferably 1,000 to 20,000. The polycarboxylate polymers are used at levels of 0.1–10%; preferably 0.1–8%; most preferably 1–6%.

Wherein further, said graft copolymers of vinyl acetate and polyalkyleneoxides is obtainable by grafting (a) a polyalkylene oxide having a number average molecular weight of from 300 to 100,000 and based on ethylene oxide, propylene oxide and/or butylene oxide with (b) vinyl acetate in a weight ratio (a):(b) of from 1:0.2 to 1:10. Further, up to 100% of the vinyl acetate groups comprising said graft co-polymer of vinyl acetate and polyalkyleneoxide can be hydrolyzed.

The detailed description of the graft co-polymers of vinyl acetate and polyalkylene oxides is provided in U.S. Pat. No. 4,746,456, issued May 24, 1988, and U.S. Pat. No. 4,999,869 issued Mar. 19, 1991, both assigned to BASF, and incorporated by reference herein.

The polycarboxylate polymers of the present invention are used at levels of 0.1–10% by weight in a detergent composition, preferably at a level of 0.1–8% by weight; most preferably 1 to 6% by weight. The graft copolymers of vinyl acetate and polyalkylene oxide of the present invention are used at levels of 0.1–10% by weight in a detergent composition, preferably at a level of 0.1–8% by weight; most preferably 1 to 6% by weight.

Preferred polycarboxylate polymers and nonionic graft copolymers of vinyl acetate and polyalkylene oxides wherein said polycarboxylate polymer has a molecular weight of 500 to 250,000 and the structural formula:

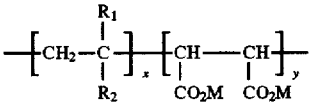

wherein $R_1$=H or $CH_3$; $R_2$ is $CO_2M$; M=H or an alkali metal; x=7–1500; y=0–1000; wherein further, said preferred graft copolymer of vinyl acetate and polyalkylene oxide is obtainable by grafting (a) a polyalkylene oxide having a number average molecular weight of from 300 to 70,000 and based on ethylene oxide, propylene oxide and/or butylene oxide with (b) vinyl acetate in a weight ratio of from 1:0.2 to 1:13.

More preferred polycarboxylate polymers and nonionic graft copolymers of vinyl acetate and polyalkylene oxides wherein said polycarboxylate polymer has a molecular weight of 1,000 to 20,000 and the structural formula:

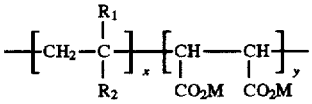

wherein $R_1$=H or $CH_3$; $R_2$ is $CO_2M$; M=H or an alkali metal; x=7–1500; y=0–1000; wherein further, said graft copolymer of vinyl acetate and polyalkyleneoxide is obtainable by grafting (a) a polyalkylene oxide having a number average molecular weight of from 300 to 50,000 and based on ethylene oxide, propylene oxide and/or butylene oxide with (b) vinyl acetate in a weight ration (a):(b) of from 1:0.2 to 1:10.

Most preferred polycarboxylate polymers and nonionic graft copolymers of vinyl acetate and polyalkylene oxides wherein said polycarboxylate polymer has a molecular weight of 1000 to 10,000 and the structural formula:

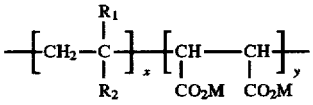

wherein $R_1$=H or $CH_3$; $R_2$ is $CO_2M$; M=H or an alkali metal; x=7–1500; y=0–1000; wherein further, said graft copolymer of vinyl acetate and polyalkyleneoxide is obtainable by grafting (a) a polyalkylene oxide having a number average molecular weight of from 300 to 30,000 and based on ethylene oxide, propylene oxide and/or butylene oxide with (b) vinyl acetate in a weight ration (a):(b) of from 1:0.2 to 1:10.

The following Examples further describe and demonstrate the present invention. The Examples are given solely for the purpose of illustration, and are not to be construed as limitations of the present invention.

The powdered machine dishwashing detergents of the present invention are prepared according to procedures known to those skilled in the art. The procedure described in U.S. Pat. No. 5,423,997 specifically describes a detergent making process, useful in making compositions of the present invention, and is incorporated by reference herein.

TESTING OF THE COMPOSITIONS OF THE PRESENT INVENTION

The compositions described in Examples 1,2,3, and 4 were evaluated using the following test method:

Five glasses were evaluated after three wash/rinse cycles, in a Gibson Model SP24 dishwasher, using 200 ppm hardness water. Cycle 1: 20 grams detergent in prewash, 25 grams fat soil in prewash, 20 grams detergent in main wash; Cycle 2: Repeat Cycle 1, add 12 grams powdered milk to main wash; Cycle 3: repeat Cycle 1, add 15 grams raw egg to main wash.

The fat soil test sample is prepared by blending 72% margarine, 18% powdered milk, 5% lard, and 5% rendered beef tallow.

Example 1 contains no polymer, Example 2 contains a homopolymer of acrylic acid and Example 3 contains a graft co-polymer of vinyl acetate and polyalkyleneoxide. Example 4 contains the polymers of Examples 2 and 3 (combined to create the present invention).

EXAMPLE 1

0% polymer
4% nonionic surfactant (INDUSTROL® DW5)
10% sodium carbonate
25% sodium metasilicate pentahydrate
10% sodium perborate monohydrate
49% sodium sulfate

EXAMPLE 2

2% 8000 molecular weight polymer of acrylic acid
4% nonionic surfactant (INDUSTROL® DW5)
10% sodium carbonate
25% sodium metasilicate pentahydrate
10% sodium perborate monohydrate
49% sodium sulfate

EXAMPLE 3

2% 24,000 molecular weight nonionic graft co-polymer of vinyl acetate and polyalkyleneoxide
4% nonionic surfactant (INDUSTROL® DW5)
10% sodium carbonate
25% sodium metasilicate pentahydrate
10% sodium perborate monohydrate
49% sodium sulfate

EXAMPLE 4

1% 24,000 molecular weight nonionic graft copolymer of vinyl acetate and polyalkylene oxide
1% 8000 molecular weight polymer of acrylic acid
4% nonionic surfactant (INDUSTROL® DW5)
10% sodium carbonate
25% sodium metasilicate pentahydrate
10% sodium perborate monohydrate
49% sodium sulfate Table 1 serves to illustrate the superior benefits of the present invention over the prior art. Clearly, spotting and filming is reduced when present invention (Example 4) is used.

TABLE 1

| EXAMPLE | SPOTTING | FILMING |
|---|---|---|
| 1 | 3.0 | 4.5 |
| 2 | 2.0 | 3.0 |
| 3 | 1.4 | 4.4 |
| 4 | 1.3 | 2.3 |

What is claimed is:

1. A nonphosphate, peroxygen based machine dishwashing composition consisting of by weight:

(a) 0.1–10% nonionic surfactants, (b) 2–40% non-phosphate builders selected from the group consisting of alkali metal salts of carbonate, bicarbonate and silicate and citrate, (c) 5–15% non-chlorine bleach, (d) 1–5% bleach precursors, (e) 0.1–10% polycarboxylate polymer wherein said polycarboxylate polymer has a molecular weight of 500–250,000 and the structural formula:

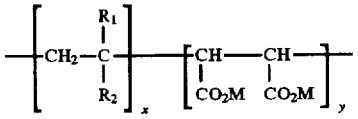

wherein $R_1$=H or $CH_3$; $R_2$ is $CO_2M$; M=H or an alkali metal; x=7–1,500; y=0–1,000;

(f) 0.1–10% nonionic graft copolymer of vinyl acetate and polyalkylene oxides wherein said nonionic graft copolymer of vinyl acetate and polyalkyleneoxide is obtained by grafting (a) a polyalkylene oxide having a number average molecular weight of from 300–100, 000 and based on ethylene oxide, propylene oxide and/or butylene oxide with (b) vinyl acetate in a weight ratio (a)(b) of from 1:0.2–1:10; and (g) balance, filler.

2. A non-phosphate, peroxygen based machine dishwashing composition consisting of by weight:

(a) 0.1–10% nonionic surfactants, (b) 2–40% non-phosphate builders selected from the group consisting of alkali metal salts of carbonate, bicarbonate and silicate and citrate, (c) 5–15% non-chlorine bleach, (d) 1–5% bleach precursors, (e) 0.5–8% enzymes, (f) 0.1–10% polycarboxylate polymers wherein said polycarboxylate polymer has a molecular weight of 500–250,000 and the structural formula:

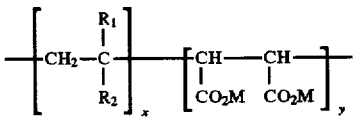

wherein $R_1$=H or $CH_3$; $R_2$ is $CO_2M$; M=H or an alkali metal; x=7–1,500; y=0–1,000;

(g) 0.1–10% nonionic graft copolymers of vinyl acetate and polyalkylene oxides wherein said nonionic graft copolymer of vinyl acetate and polyalkyleneoxide is obtained by grafting (a) a polyalkylene oxide having a number average molecular weight of from 300–100, 000 and based on ethylene oxide, propylene oxide and/or butylene oxide with (b) vinyl acetate in a weight ratio (a):(b) of from 1:0.2–1:10; and (h) balance, filler.

3. A method of reducing the spotting and filming of dishware comprising contacting said dishware with a non-phosphate, peroxygen based machine dishwashing composition comprising by weight:

(a) 0.1–10% nonionic surfactants, (b) 2–40% non-phosphate builders, (c) 5–15% non-chlorine bleach, (d) 1–5% bleach precursors, (e) 0.1–10% polycarboxylate polymer wherein said polycarboxylate polymer has a molecular weight of 500–250,000 and the structural formula:

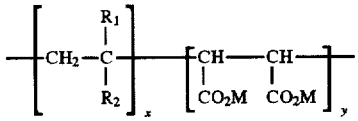

wherein $R_1$=H or $CH_3$; $R_2$ is $CO_2M$; M=H or an alkali metal; x=7–1,500; y=0–1,000;

(f) 0.1–10% nonionic graft copolymer of vinyl acetate and polyalkylene oxides wherein said nonionic graft copolymer of vinyl acetate and polyalkyleneoxide is obtained by grafting (a) a polyalkylene oxide having a number average molecular weight of from 300–100, 000 and based on ethylene oxide, propylene oxide and/or butylene oxide with (b) vinyl acetate in a weight ratio (a):(b) of from 1:0.2–1:10.

4. A method according to claim 3, wherein in (e), said polycarboxylate polymer has a molecular weight of 500–70, 000 and the structural formula:

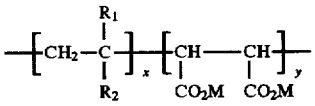

wherein $R_1$=H or $CH_3$; $R_2$ is $CO_2M$; M=H or an alkali metal; x=7–1,500; y=0–1000.

5. A method according to claim 3, wherein in (f), said nonionic graft copolymer of vinyl acetate and polyalkyleneoxide is obtained by grafting (a) a polyalkylene oxide having a number average molecular weight of from 300–70, 000 and based on ethylene oxide, propylene oxide and/or butylene oxide with (b) vinyl acetate in a weight ratio (a):(b) of from 1:0.2–1:10.

6. A method according to claim 3, wherein in (e), said polycarboxylate polymer has a molecular weight of 1,000–20,000 and the structural formula:

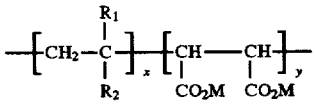

wherein $R_1$=H or $CH_3$; $R_2$ is $CO_2M$; M=H or an alkali metal; x=7–1,500; y=0–1,000.

7. A method according to claim 3, wherein in (f), said nonionic graft copolymer of vinyl acetate and polyalkyleneoxide is obtained by grafting (a) a polyalkylene oxide having a number average molecular weight of from 300–50, 000 and based on ethylene oxide, propylene oxide and/or butylene oxide with (b) vinyl acetate in a weight ratio (a):(b) of from 1:0.2–1:10.

8. A method according to claim 3, wherein:

in (a), said nonionic surfactants are selected from the group consisting of polyoxyalkylene condensates of aliphatic alcohols and polyoxyalkylene condensates of oxide block co-polymers;

in (b), said non-phosphate builders are selected from the group consisting of alkali metal salts of carbonate, bicarbonate and silicate and citrate;

in (c), said non-chlorine bleach is selected from the group consisting of perborate and percarbonate;

in (d), said bleach precursors are selected from the group consisting of TAED and TAMD.

9. A method according to claim 4, wherein:

in (a), said nonionic surfactants are selected from the group consisting of polyoxyalkylene condensates of aliphatic alcohols and polyoxyalkylene condensates of oxide block co-polymers;

in (b), said non-phosphate builders are selected from the group consisting of alkali metal salts of carbonate, bicarbonate and silicate and citrate;

in (c), said non-chlorine bleach is selected from the group consisting of perborate and percarbonate;

in (d), said bleach precursors are selected from the group consisting of TAED and TAMD.

10. A method according to claim 5, wherein:

in (a), said nonionic surfactants are selected from the group consisting of polyoxyalkylene condensates of aliphatic alcohols and polyoxyalkylene condensates of oxide block co-polymers;

in (b), said non-phosphate builders are selected from the group consisting of alkali metal salts of carbonate, bicarbonate and silicate and citrate;

in (c), said non-chlorine bleach is selected from the group consisting of perborate and percarbonate;

in (d), said bleach precursors are selected from the group consisting of TAED and TAMD.

11. A method according to claim 6, wherein:

in (a), said nonionic surfactants are selected from the group consisting of polyoxyalkylene condensates of aliphatic alcohols and polyoxyalkylene condensates of oxide block co-polymers;

in (b), said non-phosphate builders are selected from the group consisting of alkali metal salts of carbonate, bicarbonate and silicate and citrate;

in (c), said non-chlorine bleach is selected from the group consisting of perborate and percarbonate;

in (d), said bleach precursors are selected from the group consisting of TAED and TAMD.

12. A method according to claim 7, wherein:

in (a), said nonionic surfactants are selected from the group consisting of polyoxyalkylene condensates of aliphatic alcohols and polyoxyalkylene condensates of oxide block co-polymers;

in (b), said non-phosphate builders are selected from the group consisting of alkali metal salts of carbonate, bicarbonate and silicate and citrate;

in (c), said non-chlorine bleach is selected from the group consisting of perborate and percarbonate;

in (d), said bleach precursors are selected from the group consisting of TAED and TAMD.

13. A method of reducing the spotting and filming of dishware comprising contacting said dishware with a non-phosphate, peroxygen based machine dishwashing composition comprising by weight:

(a) 0.1–10% nonionic surfactants, (b) 2–40% non-phosphate builders, (c) 5–15% non-chlorine bleach, (d) 1–5% bleach precursors, (e) 0.5–8% enzymes, (f) 0.1–10% polycarboxylate polymers wherein said polycarboxylate polymer has a molecular weight of 500–250,000 and the structural formula:

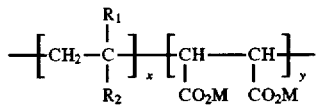

wherein $R_1$=H or $CH_3$; $R_2$ is $CO_2M$; M=H or an alkali metal; x=7–1,500; y=0–1,000;

(g) 0.1–10% nonionic graft copolymers of vinyl acetate and polyalkylene oxides wherein said nonionic graft copolymer of vinyl acetate and polyalkyleneoxide is obtained by grafting (a) a polyalkylene oxide having a number average molecular weight of from 300–100,000 and based on ethylene oxide, propylene oxide and/or butylene oxide with (b) vinyl acetate in a weight ratio (a):(b) of from 1:0.2–1:10.

14. A method according to claim 13, wherein in (f), said poly-carboxylate polymer has a molecular weight of 500–70,000 and the structural formula:

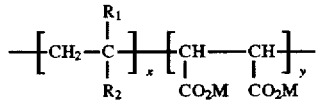

wherein $R_1$=H or $CH_3$; $R_2$ is $CO_2M$; M=H or an alkali metal; x=7–1,500; y=0–1,000.

15. A method according to claim 13, wherein in (g), said nonionic graft copolymer of vinyl acetate and polyalkyleneoxide is obtained by grafting (a) a polyalkylene oxide having a number average molecular weight of from 300–70,000 and based on ethylene oxide, propylene oxide and/or butylene oxide with (b) vinyl acetate in a weight ratio (a):(b) of from 1:0.2–1:10.

16. A method according to claim 13, wherein in (f), said polycarboxylate polymer has a molecular weight of 1,000–20,000 and the structural formula:

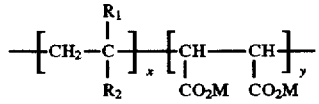

wherein $R_1$=H or $CH_3$; $R_2$ is $CO_2M$; M=H or an alkali metal; x=7–1,500; y=0–1,000.

17. A method according to claim 13, wherein in (g), said nonionic graft copolymer of vinyl acetate and polyalkyleneoxide is obtained by grafting (a) a polyalkylene oxide having a number average molecular weight of from 300–50,000 and based on ethylene oxide, propylene oxide and/or butylene oxide with (b) vinyl acetate in a weight ratio (a):(b) of from 1:0.2–1:10.

18. A method according to claim 13, wherein:

in (a), said nonionic surfactants are selected from the group consisting of polyoxyalkylene condensates of aliphatic alcohols and polyoxyalkylene condensates of oxide block co-polymers;

in (b), said non-phosphate builders are selected from the group consisting of alkali metal salts of carbonate, bicarbonate and silicate and citrate;

in (c), said non-chlorine bleach is selected from the group consisting of perborate and percarbonate;

in (d), said bleach precursors are selected from the group consisting of TAED and TAMD;

in (e), said enzymes are selected from the group consisting of amylase, lipase and protease.

* * * * *